US010960699B2

(12) United States Patent
Matsumoto

(10) Patent No.: US 10,960,699 B2
(45) Date of Patent: Mar. 30, 2021

(54) IMAGE FORMING APPARATUS

(71) Applicant: Oki Data Corporation, Tokyo (JP)

(72) Inventor: Hayato Matsumoto, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 4 days.

(21) Appl. No.: 16/447,098

(22) Filed: Jun. 20, 2019

(65) Prior Publication Data

US 2020/0070557 A1 Mar. 5, 2020

(30) Foreign Application Priority Data

Aug. 28, 2018 (JP) ..... JP2018-159307

(51) Int. Cl.
*B41M 5/382* (2006.01)

(52) U.S. Cl.
CPC ..... *B41M 5/382* (2013.01)

(58) Field of Classification Search
CPC .. B41M 5/382; B41M 5/0358; B41M 5/0256; B41F 16/00; B41F 16/0006; B41F 16/0026; B41F 16/0033
See application file for complete search history.

(56) References Cited

FOREIGN PATENT DOCUMENTS

JP 2015176032 A 10/2015

*Primary Examiner* — Kristal Feggins
(74) *Attorney, Agent, or Firm* — Panitch Schwarze Belisario & Nadel LLP

(57) ABSTRACT

An image forming apparatus includes an image forming section. The image forming section includes a first toner image forming unit and a second toner image forming unit. The first toner image forming unit forms a sublimation toner image with use of a sublimation toner. The sublimation toner includes a sublimation dye. The second toner image forming unit forms a non-sublimation toner image with use of a non-sublimation toner. The non-sublimation toner does not include the sublimation dye. The image forming section transfers the non-sublimation toner image and the sublimation toner image in this order on a print medium and thereby causes a transfer region of the non-sublimation toner image and a transfer region of the sublimation toner image to be overlapped with each other.

11 Claims, 3 Drawing Sheets

IMAGE FORMING APPARATUS

CROSS REFERENCE TO RELATED APPLICATIONS

The present application claims priority from Japanese Patent Application No. 2018-159307 filed on Aug. 28, 2018, the entire contents of which are hereby incorporated by reference.

BACKGROUND

The technology relates to an image forming apparatus that forms an image with the use of a sublimation toner including a sublimation dye.

An electrophotographic image forming apparatus is in widespread use. One reason for this is that the electrophotographic image forming apparatus is able to achieve a high-quality image in a shorter time, compared with an image forming apparatus using another method such as an inkjet method.

The electrophotographic image forming apparatus forms an image on a print medium with the use of a toner. In this case, the toner attached to an electrostatic latent image is transferred onto the print medium, and the toner is thereafter fixed to the print medium.

Various applications have been proposed of an image formed by an electrophotographic image forming apparatus. For example, after an image is formed on a print medium, the image is transferred from the print medium onto a non-print medium, such as a fabric, other than the print medium. The image is thereby formed on the non-print medium. For example, reference may be made to Japanese Unexamined Patent Application Publication No. 2015-176032.

SUMMARY

It has been proposed to form an image on a non-print medium by utilizing an image formed on a print medium. The non-print medium may be, for example but not limited to, a fabric or any other medium other than the print medium. However, quality of an image formed on the non-print medium has not been sufficiently high, which still leaves a room for improvement in the quality of the image to be formed on the non-print medium.

It is desirable to provide an image forming apparatus that makes it possible to form a higher-quality image on a non-print medium, such as a fabric, other than a print medium, when an image formed on the print medium is transferred onto the non-print medium.

According to one embodiment of the technology, there is provided an image forming apparatus that includes an image forming section. The image forming section includes a first toner image forming unit and a second toner image forming unit. The first toner image forming unit forms a sublimation toner image with use of a sublimation toner. The sublimation toner includes a sublimation dye. The second toner image forming unit forms a non-sublimation toner image with use of a non-sublimation toner. The non-sublimation toner does not include the sublimation dye. The image forming section transfers the non-sublimation toner image and the sublimation toner image in this order on a print medium and thereby causes a transfer region of the non-sublimation toner image and a transfer region of the sublimation toner image to be overlapped with each other.

DETAILED DESCRIPTION

Figure 1:
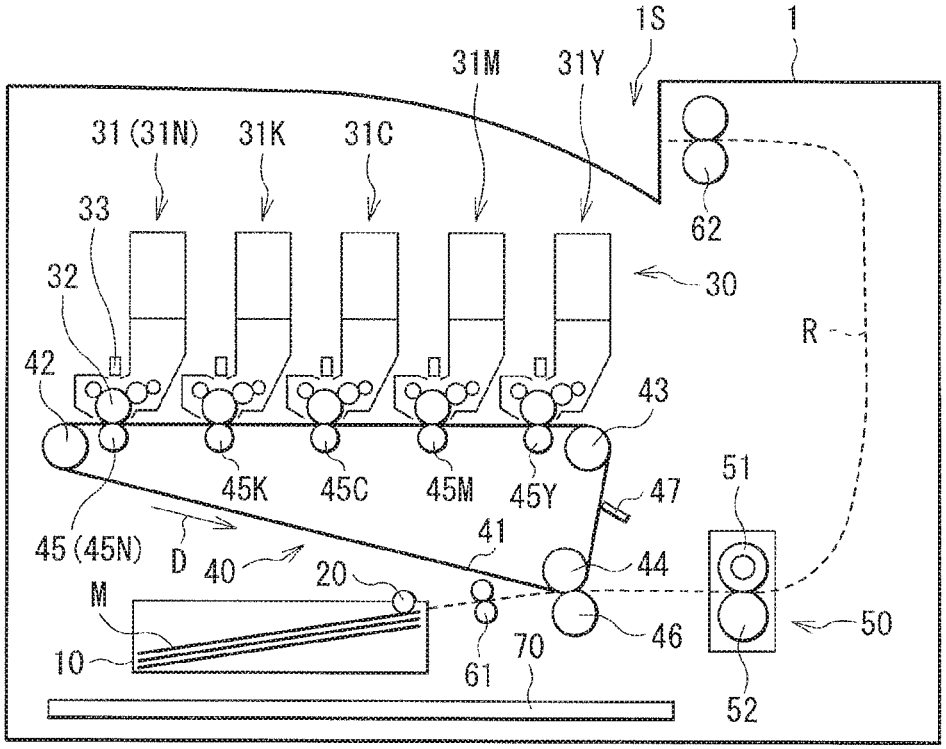
FIG. 1 is a schematic plan view of an example of a configuration of an image forming apparatus according to one embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail. The description will be given in the following order.

1. Image Forming Apparatus
   1-1. General Configuration
   1-2. Configuration of Toner
   1-3. Operation
   1-4. Example Workings and Example Effects
2. Application Examples of Image
3. Modification Examples

1. IMAGE FORMING APPARATUS

A description is given first of an image forming apparatus according to an example embodiment of the technology.

The image forming apparatus according to an example embodiment may form an image on a print medium M illustrated in FIG. 1 with the use of two types of toners, i.e., a sublimation toner and a non-sublimation toner, as will be described later. The sublimation toner and the non-sublimation toner may also be respectively referred to as a textile printing toner and a non-textile-printing toner. For example, the image forming apparatus may be a so-called electrophotographic full-color printer. For example, the image forming apparatus may employ an intermediate transfer method that forms an image on the print medium M with the use of an intermediate transfer medium, e.g., a transfer belt 41.

The print medium M is not particularly limited in its type; however, the print medium M may include one or more of materials such as paper, a film, or any other printable medium, for example.

1-1. General Configuration

FIG. 1 schematically illustrates an example of a planar configuration of the image forming apparatus. The image forming apparatus may include, for example but not limited to, a tray 10, a feeding roller 20, a developing section 30, a transfer section 40, a fixing section 50, a conveying roller 61, a conveying roller 62, and a control board 70, inside a housing 1 as illustrated in FIG. 1. The housing 1 may be provided, for example, with a stacker IS in which the print medium M formed with an image is to be discharged and accumulated. The print medium M may be conveyed along a conveyance route R illustrated by a dashed line in the image forming apparatus.

A series of rollers described below, i.e., a series of components having a name including a term "roller", may each be a cylindrical member that extends in a direction perpendicular to the paper plane of FIG. 1, and is rotatable around a rotation axis that extends in the direction perpendicular to the paper plane of FIG. 1.

[Tray and Feeding Roller]

The tray 10 may contain, for example, a plurality of print media M. The tray 10 may be attachable to and detachable from the housing 1, for example.

The feeding roller 20 may be, for example, a so-called hopping roller. The feeding roller 20 may pick up the print medium M from the tray 10 and feed the print medium M to the conveyance route R, for example.

[Developing Section]

The developing section 30 may perform a developing process with the use of a toner. For example, the developing section 30 may form an electrostatic latent image, and attach the toner to the electrostatic latent image by utilizing Coulomb force.

The developing section 30 may include, for example, a developing process unit 31 that performs the developing process. The developing process unit 31 may include, for example, a photosensitive drum 32 on which an electrostatic latent image is to be formed. Together with the developing process unit 31, for example, a light source 33 may be provided. The light source 33 may form an electrostatic latent image on a surface of the photosensitive drum 32, for example. The light source 33 may include, for example, a light-emitting diode (LED). The developing process unit 31 may further include devices such as a charging roller, a developing roller, or a feeding roller, for example.

In one example, the developing section 30 may include five developing process units 31, i.e., developing process units 31Y, 31M, 31C, 31K, and 31N. The developing process units 31Y, 31M, 31C, 31K, and 31N may be disposed, for example, in this order from upstream toward downstream in a traveling direction D of a transfer belt 41 which will be described later. In other words, the developing process unit 31N may be disposed downstream of the developing process units 31Y, 31M, 31C, and 31K. Each of the developing process units 31Y, 31M, 31C, and 31K may correspond to a "first toner image forming unit" in one specific but non-limiting embodiment of the technology. The developing process unit 31N may correspond to a "second toner image forming unit" in one specific but non-limiting embodiment of the technology.

The developing process units 31Y, 31M, 31C, 31K, and 31N may have configurations similar to each other, except for being mounted with toners different in type from each other, for example. In one example, the developing process units 31Y, 31M, 31C, 31K, and 31N may have toners different in color from each other. As described above, two types of toners, i.e., the sublimation toner and the non-sublimation toner, may be used in this example.

For example, the developing process unit 31Y may be mounted with the sublimation toner, e.g., a yellow sublimation toner. The developing process unit 31M may be mounted with the sublimation toner, e.g., a magenta sublimation toner, for example. The developing process unit 31C may be mounted with the sublimation toner, e.g., a cyan sublimation toner, for example. The developing process unit 31K may be mounted with the sublimation toner, e.g., a black sublimation toner, for example. The developing process unit 31N may be mounted with the non-sublimation toner, for example.

Each of the yellow sublimation toner, the magenta sublimation toner, the cyan sublimation toner, and the black sublimation toner may be used in forming a full-color image. In one example, each of the yellow sublimation toner, the magenta sublimation toner, the cyan sublimation toner, and the black sublimation toner may be a colored toner that is to move to a later-described non-print medium L illustrated in FIG. 6 by utilizing a sublimation transfer property upon being heated. The non-print medium L may be a medium different from the print medium M on which an image is to be formed by the image forming apparatus. Non-limiting examples of the non-print medium L may include a fabric. The non-sublimation toner may be directed to improving of quality of an image to be formed on the non-print medium L, when the image formed on the print medium M is transferred onto the non-print medium L.

The sublimation toner includes a sublimation dye. In contrast, the non-sublimation toner does not include the sublimation dye. A detailed configuration of each of the non-sublimation toner and the sublimation toners including the yellow sublimation toner, the magenta sublimation toner, the cyan sublimation toner, and the black sublimation toner will be described later.

Hereinafter, the yellow sublimation toner, the magenta sublimation toner, the cyan sublimation toner, the black sublimation toner, and the non-sublimation toner may be referred to by respective individual terms in some cases; however, the yellow sublimation toner, the magenta sublimation toner, the cyan sublimation toner, the black sublimation toner, and the non-sublimation toner may be also referred to by a generic term in other cases on an as-needed basis. For example, the yellow sublimation toner, the magenta sublimation toner, the cyan sublimation toner, the black sublimation toner, and the non-sublimation toner may be collectively referred to as a "toner". For example, the yellow sublimation toner, the magenta sublimation toner, the cyan sublimation toner, and the black sublimation toner may be collectively referred to as a "sublimation toner".

Each of the developing process units 31Y, 31M, 31C, and 31K may form a sublimation toner image TD with the use of the corresponding sublimation toner, i.e., corresponding one of the yellow sublimation toner, the magenta sublimation toner, the cyan sublimation toner, and the black sublimation toner, as will be described later. In contrast, the developing process unit 31N may form a non-sublimation toner image TN with the use of the non-sublimation toner, as will be described later. The sublimation toner image TD and the non-sublimation toner image TN will be described later with reference to FIGS. 2 and 3.

[Transfer Section]

The transfer section 40 may perform a transfer process with the use of the toner that has been subjected to the developing process by the developing section 30. For example, the transfer section 40 may transfer, onto the transfer belt 41, the toner attached to the electrostatic latent image, and thereafter transfer the toner from the transfer belt 41 onto the print medium M.

The transfer section 40 may include, for example but not limited to, the transfer belt 41, a drive roller 42, an idler roller 43, a backup roller 44, a primary transfer roller 45, a secondary transfer roller 46, and a cleaning blade 47. The transfer belt 41 may correspond to an "intermediate transfer medium" in one specific but non-limiting embodiment of the technology.

The transfer belt 41 may be an endless belt, for example. The transfer belt 41 may be able to travel in the traveling direction D, for example, in response to rotation of the drive roller 42, while lying on the drive roller 42, the idler roller 43, and the backup roller 44 in a stretched state. The drive roller 42 may be rotatable by means of a driving source such as a motor, for example. Each of the idler roller 43 and the backup roller 44 may be rotatable in accordance with the rotation of the drive roller 42, for example.

The primary transfer roller 45 may be in contact with the photosensitive drum 32 with the transfer belt 41 in between. The primary transfer roller 45 may transfer, onto the transfer belt 41, the toner attached to the electrostatic latent image. In other words, the primary transfer roller 45 may perform primary transfer. In one example, the transfer section 40 may include five primary transfer rollers 45, i.e., primary transfer rollers 45Y, 45M, 45C, 45K, and 45N. The primary transfer rollers 45Y. 45M, 45C, 45K, and 45N may be disposed, for example, in order similar to the order in which the developing process units 31Y, 31M, 31C, 31K, and 31N are disposed.

The secondary transfer roller 46 may be in contact with the backup roller 44 with the transfer belt 41 in between. The secondary transfer roller 46 may transfer, onto the print medium M, the toner that has been transferred onto the transfer belt 41. In other words, the secondary transfer roller 46 may perform secondary transfer.

The cleaning blade 47 may be in contact with the transfer belt 41. The cleaning blade 47 may scrape off extraneous remains on a surface of the transfer belt 41. Non-limiting examples of the extraneous remains may include an unnecessary toner.

Figure 2:
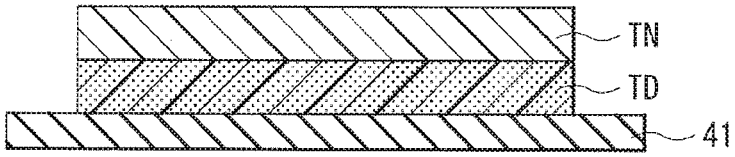
FIG. 2 is a cross-sectional view of an example of a configuration of a transfer belt onto which a sublimation toner image and a non-sublimation toner image are transferred.
Figure 3:
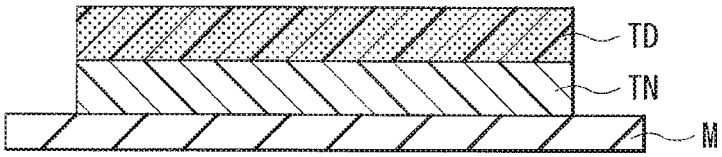
FIG. 3 is a cross-sectional view of an example of a configuration of a print medium onto which the non-sublimation toner image and the sublimation toner image are transferred from the transfer belt.

For example, as will be described later, the transfer section 40 may transfer, onto the transfer belt 41, the sublimation toner image TD and the non-sublimation toner image TN in this order, as illustrated in FIG. 2. Thereafter, the transfer section 40 may transfer the non-sublimation toner image TN and the sublimation toner image TD in this order from the transfer belt 41 onto the print medium M, as illustrated in FIG. 3. The non-sublimation toner image TN and the sublimation toner image TD may be thereby stacked in this order on the print medium M.

[Fixing Section]

The fixing section 50 may perform a fixing process with the use of the toner that has been transferred onto the print medium M by the transfer section 40. For example, the fixing section 50 may apply pressure on the print medium M onto which the toner has been transferred while heating the print medium M, thereby fixing the toner to the print medium M.

The fixing section 50 may include, for example but not limited to, a heating roller 51 and a pressure-applying roller 52 that are opposed to each other with the conveyance route R in between. The heating roller 51 may include, for example, a built-in heater. Non-limiting examples of the built-in heater may include a halogen lamp. The heating roller 51 may heat, by means of the built-in heater, the print medium M onto which the toner has been transferred. The pressure-applying roller 52 may be in contact with the heating roller 51. The pressure-applying roller 52 may thus apply pressure on the print medium M onto which the toner has been transferred.

[Conveying Roller]

Each of the conveying rollers 61 and 62 may include a pair of rollers that are opposed to each other with the conveyance route R in between. Each of the conveying rollers 61 and 62 may convey the print medium M along the conveyance route R. For example, the conveying roller 61 may serve as a registration roller that guides, to the conveyance route R, the print medium M fed from the tray 10. For example, the conveying roller 62 may serve as a discharging roller that discharges, to the stacker IS, the print medium M on which an image has been formed.

[Control Board]

The control board 70 may control general operation of the image forming apparatus. The control board 70 may be a circuit board provided with devices including a control circuit, a memory, an input-output port, and a timer. The control circuit may include, for example, a device such as a central processing unit (CPU).

For example, the control board 70 may control a positional relationship between the sublimation toner image TD formed by each of the developing process units 31Y, 31M, 31C, and 31K and the non-sublimation toner image TN formed by the developing process unit 31N, as will be described later with reference to FIGS. 2 and 3.

For example, the control board 70 may transfer the sublimation toner image TD and the non-sublimation toner image TN in this order onto the transfer belt 41, and thereby cause a transfer region of the sublimation toner image TD and a transfer region of the non-sublimation toner image TN to be overlapped with each other, as illustrated in FIG. 2. This will be described later. In this case, the sublimation toner image TD may be disposed closer to the surface of the transfer belt 41, and the non-sublimation toner image TN may be disposed farther from the surface of the transfer belt 41. The developing section 30, the transfer section 40, and the control board 70 may correspond to an "image forming section" in one specific but non-limiting embodiment of the technology.

One reason why the control board 70 causes the sublimation toner image TD and the non-sublimation toner image TN to be transferred in this order onto the transfer belt 41 is to transfer the non-sublimation toner image TN and the sublimation toner image TD in this order onto the print medium M as illustrated in FIG. 3, and thereby cause the transfer region of the non-sublimation toner image TN and the transfer region of the sublimation toner image TD to be overlapped with each other at last, as will be described later. In this case, the non-sublimation toner image TN may be disposed closer to the surface of the print medium M, and the sublimation toner image TD may be disposed farther from the surface of the print medium M.

[Disposed Amount of Non-Sublimation Toner Image]

The non-sublimation toner may be directed to improving, in a case where an image formed on the print medium M is to be transferred onto the non-print medium L, of quality of an image to be transferred onto the non-print medium L as described above. A disposed amount (mg/cm$^2$) of the non-sublimation toner image TN formed with the use of the non-sublimation toner is not particularly limited. One reason for this is that, as long as the non-sublimation toner image TN is formed together with the sublimation toner image TD, the quality of the image to be transferred onto the non-print medium L is improved compared with that in a case without the formation of the non-sublimation toner image TN. The disposed amount of the non-sublimation toner image TN described above refers not to a disposed amount of the non-sublimation toner image TN formed on the transfer belt 41 but to a disposed amount of the non-sublimation toner image TN formed on the print medium M.

In one example embodiment, the disposed amount of the non-sublimation toner image TN may be equal to or greater than 0.10 mg/cm$^2$. One reason for this is that the amount of the sublimation dye to move to the non-print medium L is secured, which achieves a higher density of the image formed on the non-print medium L independently of the color of the sublimation toner.

In one example embodiment, the disposed amount of the non-sublimation toner image TN may be equal to or greater than 0.20 mg/cm$^2$. One reason for this is that this achieves a higher density of the image formed on the non-print medium L.

In one example embodiment, the disposed amount of the non-sublimation toner image TN may be equal to or greater than 0.38 mg/cm$^2$. One reason for this is that this achieves a further higher density of the image formed on the non-print medium L. Another reason for the above is that the above also achieves superior gray-scale reproducibility, which enables a wide range of middle-tone color gamut, i.e., a wide range of half-tone color gamut.

In one example embodiment, the disposed amount of the non-sublimation toner image TN may be equal to or smaller than 0.65 mg/cm$^2$. One reason for this is that an excessively-great disposed amount of the non-sublimation toner image TN can cause a problem. To give an example, the problem may be difficulty in fixing the non-sublimation toner due to the excessively-great disposed amount of the non-sublimation toner.

The disposed amount of the non-sublimation toner image TN may be measured by the following procedure, for example. First, a jig having a planar portion at its tip may be prepared. An area of the planar portion may be, for example, 1 cm$^2$. Thereafter, a double-sided tape may be attached to the planar portion. Thereafter, a voltage may be applied to the tip of the jig, i.e., to the planar portion of the jig, by means of an external power source. The voltage to be applied may be, for example, +300 V. Thereafter, the print medium M onto which the non-sublimation toner image TN has been transferred may be taken out of the image forming apparatus. The foregoing transfer of the non-sublimation toner image TN onto the print medium M may be a result of the transfer process performed by the image forming apparatus. The foregoing non-sublimation toner image TN may have a solid image pattern and a printing rate of 100%. In the above-described state, the non-sublimation toner image TN transferred onto the print medium M may have not been subjected to the fixing process yet. Therefore, the non-sublimation toner image TN in the above-described state may include a so-called unfixed non-sublimation toner. Thereafter, the planar portion of the jig may be pressed against the non-sublimation toner image TN formed on the print medium M. This may cause the unfixed non-sublimation toner to be attached to the double-sided tape on the jig. Thereafter, an amount of the unfixed non-sublimation toner attached to the double-sided tape may be measured by means of an electronic balance. For example, the above-described measurement may be performed on any three locations on the print medium M, by which three values of the attached amounts of the unfixed non-sublimation toner may be obtained. Thereafter, an average value of the obtained three values of the attached amounts of the unfixed non-sublimation toner may be calculated. The calculated average value may be used as the disposed amount of the non-sublimation toner image TN.

1-2. Configuration of Toner

The toner described below may be a negatively-charged toner for a single component development, for example. In other words, the toner may have a negatively-charged polarity, for example. The single component development provides the toner itself with an appropriate amount of electric charge and thereby applies an electric charge to the toner without using a carrier, e.g., a magnetic particle. In contrast, a two component development provides a mixture of the foregoing carrier and the toner and thereby applies an appropriate amount of electric charge to the toner by utilizing friction between the foregoing carrier and the toner.

A method of manufacturing the toner is not particularly limited. Non-limiting examples of the method of manufacturing the toner may include pulverization and polymerization. Two or more of the foregoing methods may be used in any combination. Non-limiting examples of the polymerization may include an emulsion polymerization aggregation method and a solution suspension method.

[Non-Sublimation Toner]

The non-sublimation toner may be directed to improving of quality of an image to be transferred onto the non-print medium L, when the image formed on the print medium M is transferred onto the non-print medium L, as described above. In one example, the non-sublimation toner may be used to form the non-sublimation toner image TN.

The non-sublimation toner may include, for example but not limited to, binder resin. The binder resin may include, for example, one or more of polymer compounds including polyester-based resin, styrene-acrylic-based resin, epoxy-based resin, and styrene-butadiene-based resin.

As used herein, the term "polyester-based resin" collectively refers to polyester and a derivative thereof. The wording "-based" of the term "polyester-based resin" indicates that the term encompasses not only polyester but also the derivative thereof. The usage of the wording "-based" is similarly applicable to other terms such as the "styrene-acrylic-based resin", the "epoxy-based resin", and the "styrene-butadiene-based resin".

In one example embodiment, the polymer compound may include the polyester-based resin. One reason for this is that, when the image formed on the print medium M is transferred onto the non-print medium L, break of a portion of a non-sublimation image GN makes it easier for the broken portion of the non-sublimation image GN to move to the non-print medium L together with a portion of a sublimation image GD, as will be described later with reference to FIG. 7. Another reason for the above is that high affinity of the polyester-based resin for the print medium M such as paper makes it easier for the non-sublimation toner including the polyester-based resin to be fixed to the print medium M. Still another reason for the above is that high affinity of the polyester-based resin for the non-print medium L such as a fabric makes it easier for the non-sublimation toner including the polyester-based resin to be fixed to the non-print medium L. Still another reason for the above is that high physical strength of the polyester-based resin even of a relatively-small molecular weight allows the non-sublimation toner including the polyester-based resin to have superior durability. Still another reason for the above is that it is easier even for the non-sublimation toner having a low electric charge characteristic to be fixed to the print medium M.

The polyester-based resin is not particularly limited in its crystalline state. Therefore, the polyester-based resin may be crystalline polyester, amorphous polyester, or both.

The non-sublimation toner is not particularly limited in its color. Accordingly, the non-sublimation toner may include a colorant, or may include no colorant. The colorant included in the non-sublimation toner may have a dying property as with the colorant, i.e., the sublimation dye, included in the sublimation toner, for example. Alternatively, the colorant included in the non-sublimation toner may have no dying property unlike the colorant included in the sublimation toner.

In a case where the non-sublimation toner includes no colorant, the non-sublimation toner may be colorless or transparent. The colorless non-sublimation toner may be a so-called clear toner, for example. In this case, the non-sublimation toner image TN may be colorless, which makes a hue of the non-sublimation toner image TN hardly influence a hue of the sublimation toner image TD.

In a case where the non-sublimation toner includes a colorant with no dying property, the color of the non-sublimation toner is not particularly limited. Accordingly, the color of the non-sublimation toner may be yellow, magenta, cyan, black, white, or a mixture of two or more thereof, for example. In this case, the non-sublimation toner may include, for example, a colorant of a color corresponding to the color of the non-sublimation toner. The colorant may include, for example, one or more of pigments and dyes. For example, a white non-sublimation toner may include a pigment such as titanium oxide.

In one example embodiment, the non-sublimation toner may have a color that makes it more difficult for the hue of the non-sublimation toner image TN to influence the hue of the sublimation toner image TD. Therefore, in one example embodiment, the color of the non-sublimation toner may be white. It is to be noted that, however, the color of the non-sublimation toner is not particularly limited to white as long as it is difficult for the hue of the non-sublimation toner image TN to influence the hue of the sublimation toner image TD. For example, the color of the non-sublimation toner may be a pale color such as pale gray.

In a case where the non-sublimation toner includes a colorant having the dying property, the color of the non-sublimation toner is not particularly limited. Accordingly, the color of the non-sublimation toner may be yellow, magenta, cyan, black, white, or a mixture of two or more thereof, as with the above-described case where the non-sublimation toner includes the colorant with no dying property. In this case, the non-sublimation toner may include, for example, a colorant of a color corresponding to the color of the non-sublimation toner. The colorant may include, for example, one or more of dyes having the dying property, i.e., sublimation dyes. Details of the sublimation dye of each color may be similar to those of the colorant, i.e., the sublimation dye, included in the sublimation toner, which will be described later.

In one example embodiment, the non-sublimation toner may have a color that makes it more difficult for the hue of the non-sublimation toner image TN to influence the hue of the sublimation toner image TD, as described above. Therefore, in one example embodiment, the non-sublimation toner may be colorless, transparent, or white. Further, in another example embodiment, the non-sublimation toner may be colorless. In other words, in one example embodiment, the non-sublimation toner may be a colorless or clear toner that includes no colorant.

The non-sublimation toner may further include one or more other materials such as an additive. The other materials are not particularly limited in their types. Non-limiting examples of the other materials may include an external additive, a release agent, an electric charge control agent, a fluorescent whitener, an electric conductivity modifier, a reinforcement filler, an antioxidant, an antistaling agent, a flow improver, and a cleaning improver.

The external additive may mainly suppress a phenomenon such as aggregation in the toner, and thereby improve fluidity of the toner. The external additive may include one or more materials such as an inorganic material or an organic material, for example. Non-limiting examples of the inorganic material may include hydrophobic silica. Non-limiting examples of the organic material may include melamine resin. The external additive is not particularly limited in its content. In one example embodiment, the content of the external additive with respect to 100 parts by weight of the binder resin may be from 0.1 parts by weight to 10 parts by weight both inclusive. In another example embodiment, the content of the external additive with respect to 100 parts by weight of the binder resin may be from 0.05 parts by weight to 8 parts by weight both inclusive.

The release agent may mainly improve a characteristic, of the toner, such as a fixing characteristic or offset resistance. The release agent may include, for example, one or more of waxes such as aliphatic-hydrocarbon-based wax, an oxide of aliphatic-hydrocarbon-based wax, fatty-acid-ester-based wax, or a deoxide of fatty-acid-ester-based wax. Other than the waxes described above, the release agent may also be a block copolymer of any of the above-described series of waxes, for example. The release agent is not particularly limited in its content. In one example embodiment, the content of the release agent with respect to 100 parts by weight of the binder resin may be from 0.1 parts by weight to 20 parts by weight both inclusive. In another example embodiment, the content of the release agent with respect to 100 parts by weight of the binder resin may be from 0.5 parts by weight to 12 parts by weight both inclusive.

Non-limiting examples of the aliphatic-hydrocarbon-based wax may include low-molecular polyethylene, low-molecular polypropylene, a copolymer of olefin, microcrystalline wax, paraffin wax, and Fischer-Tropsch wax. Non-limiting examples of the oxide of aliphatic-hydrocarbon-based wax may include oxidized polyethylene wax. Non-limiting examples of the fatty-acid-ester-based wax may include carnauba wax and montanic acid ester wax. The deoxide of fatty-acid-ester-based wax may be partially-deoxidized or fully-deoxidized fatty-acid-ester-based wax. Non-limiting examples of the deoxide of fatty-acid-ester-based wax may include deoxidized carnauba wax.

The electric charge control agent may mainly control a characteristic such as a triboelectric charging characteristic of the toner. The electric charge control agent to be used for the negatively-charged toner may include one or more materials such as an azo-based complex, a salicylic-acid-based complex, or a calixarene-based complex, for example. The electric charge control agent is not particularly limited in its content. In one example embodiment, the content of the electric charge control agent with respect to 100 parts by weight of the binder resin may be from 0.05 parts by weight to 15 parts by weight both inclusive.

The fluorescent whitener may mainly increase whiteness of the toner. In one example embodiment, the toner may include the fluorescent whitener in a case where the binder resin colored in any color other than white causes unintentional coloring of the toner into the color other than white. In the above-described case where the binder resin is colored in any color other than white, the binder resin may be colored slightly in yellow, for example. One reason why the toner includes the fluorescent whitener in one example embodiment is that the increase in whiteness of the toner or the binder resin causes the color of the toner to be closer to white. In a case where the toner includes the fluorescent whitener, the toner may emit blue light when the toner receives ultraviolet light. On the basis of this fact, the fluorescent whitener may be considered as one type of colorant. However, the fluorescent whitener described herein may be an additive (a component) directed to increasing of the whiteness of the toner. Therefore, the fluorescent whitener is distinct from the colorant in its component.

[Sublimation Toner (Yellow Sublimation Toner, Magenta Sublimation Toner, Cyan Sublimation Toner, and Black Sublimation Toner)]

The yellow sublimation toner, the magenta sublimation toner, the cyan sublimation toner, and the black sublimation toner may include the respective sublimation dyes of the corresponding colors. The foregoing sublimation dyes may include the yellow sublimation dye, the magenta sublimation dye, the cyan sublimation dye, and the black sublimation dye.

For example, the yellow sublimation toner may have a configuration similar to that of the non-sublimation toner except that the yellow sublimation toner may include, as the colorant, one or more of the yellow sublimation dyes. Non-limiting examples of the yellow sublimation dye may include C. L Reactive Yellow 2, C. L Disperse Yellow 54, Disperse Yellow 160, and C. L Yellow 114. The yellow sublimation toner may include no release agent, unlike the non-sublimation toner, for example.

The magenta sublimation toner may have, for example, a configuration similar to that of the yellow sublimation toner except that the magenta sublimation toner may include the magenta sublimation dye in place of the yellow sublimation dye. Non-limiting examples of the magenta sublimation dye may include C. L Reactive Red 3, C. L Disperse Red 50, and C. L Disperse Red 92.

The cyan sublimation toner may have, for example, a configuration similar to that of the yellow sublimation toner except that the cyan sublimation toner may include the cyan sublimation dye in place of the yellow sublimation dye. Non-limiting examples of the cyan sublimation dye may include C. L Disperse Blue 60, C. L Reactive Blue 15, C. L Disperse Blue 359, C. L Solvent Blue 63, C. L Disperse Blue 165, and Cibacron Turquoise Blue FGF-P.

The black sublimation toner may have, for example, a configuration similar to that of the yellow sublimation toner except that the black sublimation toner may include the black sublimation dye in place of the yellow sublimation dye. Non-limiting examples of the black sublimation dye may include C. L Reactive Black 5. It is to be noted that the black sublimation dye may be a mixture of the yellow sublimation dye, the magenta sublimation dye, and the cyan sublimation dye in one example.

Each of the yellow sublimation toner, the magenta sublimation toner, the cyan sublimation toner, and the black sublimation toner is not particularly limited in its content. In one example embodiment, the content of each of the yellow sublimation toner, the magenta sublimation toner, the cyan sublimation toner, and the black sublimation toner with respect to 100 parts by weight of the binder resin may be from 2 parts by weight to 25 parts by weight both inclusive. In another example embodiment, the content of each of the yellow sublimation toner, the magenta sublimation toner, the cyan sublimation toner, and the black sublimation toner with respect to 100 parts by weight of the binder resin may be from 2 parts by weight to 15 parts by weight both inclusive.

1-3. Operation

Figure 4:
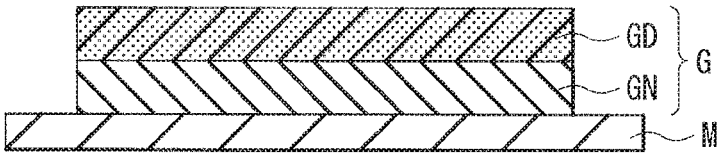
FIG. 4 is a cross-sectional view of an example of a configuration of a print medium on which images, i.e., a non-sublimation image and a sublimation image, are formed as a result of a fixing process.

FIG. 2 illustrates a cross-sectional configuration of the transfer belt 41 onto which the sublimation toner image TD and the non-sublimation toner image TN have been transferred. FIG. 3 illustrates a cross-sectional configuration of the print medium M onto which the non-sublimation toner image TN and the sublimation toner image TD have been transferred from the transfer belt 41. FIG. 4 illustrates a cross-sectional configuration of the print medium M on which an image G including a non-sublimation image GN and a sublimation image GD is formed by means of the fixing process.

In each of FIGS. 2 and 3, the sublimation toner image TD is hatched for a purpose of easy differentiation between the sublimation toner image TD and the non-sublimation toner image TN. In FIG. 4, the sublimation image GD is hatched for a purpose of easy differentiation between the sublimation image GD and the non-sublimation image GN.

In a case of forming the image G on the print medium M, the image forming apparatus may perform a developing process, a primary transfer process, a secondary transfer process, and a fixing process in this order, for example, as described below in response to transmission of image data from an external apparatus to the image forming apparatus and in response to feeding of the print medium M by the feeding roller 20 from the tray 10 to the conveyance route R. Non-limiting examples of the external apparatus may include a personal computer. Operation related to a series of processes described below may be controlled by the control board 70.

[Developing Process]

In the developing section 30, the developing process unit 31, i.e., each of the developing process units 31Y, 31M, 31C, and 31K, may form an electrostatic latent image on the surface of the corresponding photosensitive drum 32 and attach the sublimation toner to the electrostatic latent image. Further, the developing process unit 31. i.e., the developing process unit 31N, may form an electrostatic latent image on the surface of the corresponding photosensitive drum 32 and attach the non-sublimation toner to the electrostatic latent image.

[Primary Transfer Process]

In the transfer section 40, the sublimation toner may be subjected to primary transfer from the surface of or the electrostatic latent image on the photosensitive drum 32 onto the surface of the transfer belt 41 in response to traveling of the transfer belt 41 in the traveling direction D. This may be caused as a result of the primary transfer roller 45, i.e., each of the primary transfer rollers 45Y, 45M, 45C, and 45K, being in contact with the photosensitive drum 32 with the transfer belt 41 in between. This may form the sublimation toner image TD including the sublimation toner on the surface of the transfer belt 41, as illustrated in FIG. 2.

Thereafter, in response to further traveling of the transfer belt 41 in the traveling direction D, the non-sublimation toner may be subjected to primary transfer from the surface of the photosensitive drum 32 onto the surface of the transfer belt 41. This may be caused as a result of the primary transfer roller 45, i.e., the primary transfer roller 45N, being in contact with the corresponding photosensitive drum 32 with the transfer belt 41 in between, and on the basis of a principle similar to that of transferring of the sublimation toner described above. This may form the non-sublimation toner image TN including the non-sublimation toner on the sublimation toner image TD, as illustrated in FIG. 2. In this case, the sublimation toner image TD and the non-sublimation toner image TN may be so transferred onto the transfer belt 41 in this order that a transfer region of the sublimation toner image TD and a transfer region of the non-sublimation toner image TN are overlapped with each other. In one example embodiment, the sublimation toner image TD and the non-sublimation toner image TN may be so transferred onto the transfer belt 41 in this order that the transfer region of the non-sublimation toner image TN is overlapped with at least a portion of the transfer region of the sublimation toner image TD. In other words, the transfer region of the sublimation toner image TD and the transfer region of the non-sublimation toner image TN may be completely coincident with each other, or may be slightly shifted from each other, for example. This may cause the sublimation toner image TD and the non-sublimation toner image TN to be stacked in this order on the transfer belt 41. A range of the shift, or a distance, between the transfer region of the sublimation toner image TD and the transfer region of the non-sublimation toner image TN described above is not particularly limited. In one example embodiment, the range of the shift or the distance described above may be equal to or smaller than 130 μm.

Whether each of the developing process units 31Y, 31M, 31C, and 31K actually performs the developing process may be determined on the basis of the colors, or a combination of colors, necessary to form the sublimation toner image TD. This is similarly applicable to whether each of the primary transfer rollers 45Y, 45M, 45C, and 45K actually performs the primary transfer process.

[Secondary Transfer Process]

In response to further traveling of the transfer belt 41 in the traveling direction D in the transfer section 40, the non-sublimation toner image TN and the sublimation toner image TD may be subjected to secondary transfer in this order from the surface of the transfer belt 41 onto the surface of the print medium M. This may be caused as a result of the secondary transfer roller 46 being in contact with the backup roller 44 with the transfer belt 41 in between. The above-described secondary transfer may invert a positional relationship between the sublimation toner image TD and the non-sublimation toner image TN, causing the non-sublimation toner image TN and the sublimation toner image TD to be stacked in this order on the print medium M, as illustrated in FIG. 3.

[Fixing Process]

In the fixing section 50, each of the non-sublimation toner image TN and the sublimation toner image TD may be heated by the heating roller 51 while being applied with pressure by the pressure-applying roller 52. This may collectively fix both of the non-sublimation toner image TN and the sublimation toner image TD to the print medium M, forming the image G on the print medium M as illustrated in FIG. 4. The image G may include the non-sublimation image GN and the sublimation image GD. The non-sublimation image GN may be formed as a result of the fixing process performed on the non-sublimation toner image TN. The sublimation image GD may be formed as a result of the fixing process performed on the sublimation toner image TD. In other words, the non-sublimation image GN and the sublimation image GD may be stacked in this order on the print medium M.

For example, the image G formed on the print medium M may be transferable from the print medium M onto the non-print medium L illustrated in FIG. 6 by utilizing the property of the sublimation dye that allows for moving of the sublimation dye from the print medium M to the non-print medium L in response to a heating process, as will be described later. For this reason, in a case of forming the image G on the print medium M, the image G may be so formed in a horizontally-inverted state that the image G transferred onto the non-print medium L has a desired direction, for example.

Operation of forming the image G may be thereby completed. The print medium M on which the image G is formed may be conveyed along the conveyance route R and discharged to the stacker IS.

1-4. Example Workings and Example Effects

In the image forming apparatus according to the above-described example embodiment, each of the developing process units 31Y, 31M, 31C, and 31K may form the sublimation toner image TD with the use of the sublimation toner, and the developing process unit 31N may form the non-sublimation toner image TN with the use of the non-sublimation toner. This causes the non-sublimation toner image TN and the sublimation toner image TD to be transferred in this order onto the print medium M. Accordingly, when the image G formed on the print medium M is transferred onto the non-print medium L such as a fabric, an image I with higher quality is formed on the non-print medium L, for example, for the following reasons.

Figure 5:
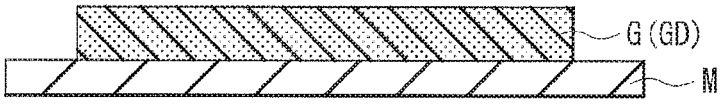
FIG. 5 is a cross-sectional view of an example of a configuration of a print medium on which an image, i.e., a sublimation image, of a comparative example is formed.

FIG. 5 illustrates a cross-sectional configuration of the print medium M on which an image G according to a comparative example is formed, and corresponds to FIG. 4. The image G according to the comparative example has a configuration similar to that of the image G according to the above-described example embodiment illustrated in FIG. 4 except that the image G according to the comparative example includes only the sublimation image GD.

An example application of the image G formed on the print medium M with the use of the sublimation toner may be to form the image I corresponding to the image G on the non-print medium L by transferring the image G onto the non-print medium L, such as a fabric, illustrated in FIG. 6, as will be described later. Non-limiting examples of the image forming method in this case may include so-called T-shirt printing in a case where the non-print medium L is a T-shirt.

The image G according to the comparative example includes only the sublimation image GD, as illustrated in FIG. 5. Therefore, the image G i.e., the sublimation image GD, includes the sublimation toner. Accordingly, when the print medium M is heated while the print medium M is closely attached to the non-print medium L, the sublimation dye included in the image G or the sublimation toner moves to the non-print medium L. The non-print medium L is thereby dyed with the sublimation dye, causing the image G to be transferred onto the non-print medium L. In this case, when the image G includes a material such as the binder resin together with the sublimation toner, the material such as the binder resin remains on the print medium M and only the sublimation dye moves from the print medium M to the non-print medium L. As a result, the image I is formed on the non-print medium L.

However, depending on the material of the non-print medium L, it may be more difficult for the sublimation dye included in the sublimation toner to move to the non-print medium L. Further, it may also be more difficult for the non-print medium L to be dyed with the sublimation dye. This may result in a decrease in efficiency of transferring the image G from the print medium M onto the non-print medium L. Accordingly, the image I transferred onto the non-print medium L may have insufficient density, and color reproducibility may be decreased. Hence, it is difficult to form the image I with higher quality on the non-print medium L.

In contrast, the image G according to the above-described example embodiment may include the non-sublimation image GN including the sublimation toner between the print medium M and the sublimation image GD including the sublimation toner, as illustrated in FIG. 4. In this case, when the print medium M is heated while the print medium M is closely attached to the non-print medium L, the sublimation dye included in the sublimation image GD or the sublimation toner may move to the non-print medium L. This causes the non-print medium L to be dyed with the sublimation dye. In addition, break of a portion of the non-sublimation image GN may cause the portion of the non-sublimation image GN to be transferred onto the non-print medium L together with a portion of the sublimation image GD, as will be described later. In other words, the portion of the sublimation image GD itself including the sublimation dye may move to the non-print medium L. As a result, the image I may be formed on the non-print medium L.

In this case, a great amount of sublimation dye included in the sublimation image GD or the sublimation toner may move to the non-print medium L, resulting in an increase in efficiency of transferring the image G from the print medium M onto the non-print medium L. This secures the density of the image G transferred onto the non-print medium L and improves color reproducibility. Hence, it is possible to form the image I with higher quality on the non-print medium L. In other words, it is possible to form, on the print medium M, the image G with higher quality that allows for formation of the image I with higher quality.

For example, the print medium M is not particularly limited in its type as long as the print medium M allows the sublimation image GD including the sublimation toner to be fixed to the print medium M. Further, the non-print medium L is not particularly limited in its type as long as the non-print medium L is able to be dyed with the sublimation dye. Hence, it is possible to increase freedom regarding the type or the material of the print medium M, and to increase freedom regarding the type or the material of the non-print medium L.

In addition, in a case where the disposed amount of the non-sublimation toner image TN is equal to or greater than 0.10 mg/cm$^2$, the amount of the sublimation dye to move to the non-print medium L is secured. This allows for high density of the image I formed on the non-print medium L independently of the color of the sublimation dye. Hence, it is possible to obtain a higher effect.

In the above-described case, when the disposed amount of the non-sublimation toner image TN is equal to or greater than 0.20 mg/cm$^2$, high density of the image I formed on the non-print medium L is obtained, and in addition, gray-scale reproducibility is secured. Hence, it is possible to obtain a further higher effect. When the disposed amount of the non-sublimation toner image TN is equal to or greater than 0.38 mg/cm$^2$, superior gray-scale reproducibility is obtained stably. Hence, it is possible to obtain a remarkably-higher effect.

In a case where the disposed amount of the non-sublimation toner image TN is equal to or smaller than 0.65 mg/cm$^2$, the above-described advantages are obtained while occurrence of a problem such as insufficient fixing is suppressed. Hence, it is possible to obtain a further higher effect.

In a case where the non-sublimation toner includes no colorant and includes the polyester-based resin, it is easier for a portion of the non-sublimation image GN to be broken while an influence of the hue of the non-sublimation image GN or the non-sublimation toner image TN on the hue of the sublimation image GD or the sublimation toner image TD is suppressed. Hence, it is possible to obtain a higher effect.

In a case where the image forming apparatus includes the transfer belt 41, and the sublimation toner image TD and the non-sublimation toner image TN are transferred onto the print medium M via the transfer belt 41, each of the sublimation toner image TD and the non-sublimation toner image TN is formed stably and transferred stably. This makes it easier for a portion of the non-sublimation image GN to be broken stably. Accordingly, it is easier for a portion of the non-sublimation image GN to be transferred onto the non-print medium L stably. Hence, it is possible to obtain a higher effect.

In a case where the image forming apparatus includes the fixing section 50 that fixes the sublimation toner image TD and the non-sublimation toner image TN to the print medium M, each of the sublimation image GD and the non-sublimation image GN is formed stably. This makes it easier for a portion of the non-sublimation image GN to be broken stably. Accordingly, it is easier for a portion of the non-sublimation image GN to move to the non-print medium L stably. Hence, it is possible to obtain a higher effect.

In this case, when the non-sublimation toner image TN and the sublimation toner image TD are stacked in this order on the print medium M, and thereafter, the fixing section 50 collectively fixes the non-sublimation toner image TN and the sublimation toner image TD to the print medium M, it is sufficient that the fixing process directed to formation of the image G including the non-sublimation image GN and the sublimation image GD is performed once. This allows the fixing process to be efficient, making it easier for the image G to be formed on the print medium M and making it easier for the image I to be formed on the non-print medium L. Hence, it is possible to obtain a further higher effect.

2. APPLICATION EXAMPLES OF IMAGE

The image G formed on the print medium M by the image forming apparatus may be transferable from the print medium M onto the non-print medium L by utilizing the sublimation transfer property, i.e., the property of the sublimation dye that allows the sublimation dye to move from the print medium M to the non-print medium L in response to a heating process, as described above. This allows for various applications of the image G depending on the type of the non-print medium L.

The type of the non-print medium L is not particularly limited. Non-limiting examples of the non-print medium L may include paper, a fabric, wood, metal, glass, ceramic, and resin. Non-limiting examples of the fabric may include clothes such as a T-shirt. Non-limiting examples of the ceramic may include dishes such as a mug. It is to be noted that the fabric is not limited to clothes, and the ceramic is not limited to dishes. A material of the fabric including clothes is not particularly limited. In one example embodiment, the material of the fabric may be polyester. One reason for this is that the polyester is easily dyed with the sublimation toner.

A description is given below of a method of transferring the image G formed by the image forming apparatus. As an example, a case where the non-print medium L is a fabric as described above is described below. The method of transferring the image G described below may be iron-on transfer that uses an iron as a heating source, for example. The non-print medium L may be clothes such as a T-shirt, for example.

Figure 6:
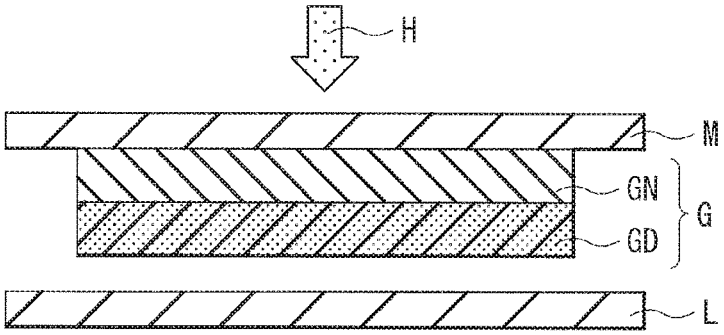
FIG. 6 is a cross-sectional view for explaining a method of transferring an image onto a non-print medium.
Figure 7:
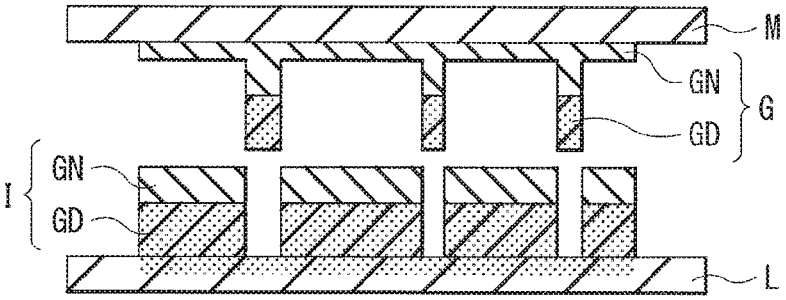
FIG. 7 is a cross-sectional view for explaining a state of an image transferred onto a non-print medium.
Figure 8:
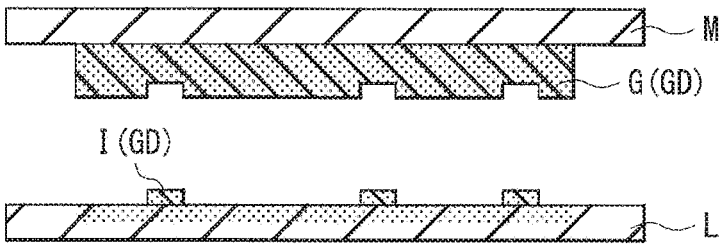
FIG. 8 is a cross-sectional view for explaining a state of an image transferred onto a non-print medium according to a comparative example.

FIG. 6 illustrates a cross-sectional configuration corresponding to that illustrated in FIG. 4 for describing the method of transferring the image G onto the non-print medium L. FIG. 7 illustrates a cross-sectional configuration corresponding to that illustrated in FIG. 6 for describing a transferred state of the image G that has been transferred onto the non-print medium L. FIG. 8 illustrates a cross-sectional configuration corresponding to that illustrated in FIG. 5 for describing a method of transferring the image G onto the non-print medium L and a transferred state of the image G that has been transferred onto the non-print medium L according to a comparative example.

In a case of transferring the image G onto the non-print medium L, as illustrated in FIG. 6, the print medium M on which the image G including the non-sublimation image GN and the sublimation image GD is formed may be first caused to be opposed to the non-print medium L. This may cause the print medium M to be so disposed that the non-sublimation image GN is opposed to the non-print medium L.

Thereafter, the print medium M may be closely attached to the non-print medium L. Thereafter, an iron may be pressed on the print medium M, thereby suppling thermal energy H to the print medium M. FIG. 6 illustrates only the thermal energy H and omits illustration of the iron. It is to be noted that conditions regarding the iron may be set to any conditions. Non-limiting examples of the conditions regarding the iron may include a temperature of the iron, a time period during which the iron is pressed on the print medium M, and a weight applied to the print medium M by means of the iron.

In this case, as illustrated in FIG. 7, the sublimation dye included in the sublimation image GD or the sublimation toner may move to the non-print medium L by utilizing the thermal energy H, which may cause the non-print medium L to be dyed with the sublimation dye. Further, break of a portion of the non-sublimation image GN may cause the portion of the non-sublimation image GN to move to the non-print medium L together with a portion of the sublimation image GD. Therefore, the portion of the sublimation image GD may be fixed to the non-print medium L. One reason why the non-sublimation image GN is broken is that close attachment force between the print medium M and the non-sublimation image GN is sufficiently greater than close attachment force of the non-sublimation image GN itself and close attachment force between the sublimation image GD and the non-sublimation image GN is also sufficiently greater than the close attachment force of the non-sublimation image GN itself. Accordingly, a portion of the non-sublimation image GN may be broken in the middle of the moving from the print medium M to the non-print medium L in a direction from the print medium M toward the non-print medium L. This may cause the portion of the non-sublimation image GN to move to the non-print medium L together with a portion of the sublimation image GD. The image G may be thereby transferred from the print medium M onto the non-print medium L. As a result, the image I corresponding to the image G may be formed on the non-print medium L.

In a case where the image I is formed on the non-print medium L, not only the sublimation dye may move from the print medium M to the non-print medium L, but also the sublimation image GD itself may move from the print medium M to the non-print medium L together with the non-sublimation image GN, as described above. This remarkably increases an absolute amount of the sublimation dye to move from the print medium M to the non-print medium L. Hence, the image I formed on the non-print medium L has higher density.

In this case, the amount of the sublimation image GD to move from the print medium M to the non-print medium L may increase as the thermal energy H increases. This allows the image I formed on the non-print medium L to have not only higher density but also superior gray-scale reproducibility. This makes it easier to control the density of the image I on the basis of the thermal energy H and allows for a wider reproducible range of the density of the image I.

In a comparative case where the image G is transferred onto the non-print medium L with the use of the print medium M on which the image G including only the sublimation image GD, the sublimation dye in the sublimation image GD or the sublimation toner moves to the non-print medium L by utilizing the thermal energy H, as illustrated in FIG. 8. However, the sublimation image GD is hardly broken, which prevents the sublimation image GD itself from moving to the non-print medium L or allows only a small amount of the sublimation image GD to move to the non-print medium L even in a case where the GD moves. One reason why the sublimation image GD hardly moves to the non-print medium L is that close attachment force of the sublimation image GD itself is sufficiently great, unlike that of the non-sublimation image GN described above. Accordingly, the substantial amount of the sublimation dye to move from the print medium M to the non-print medium L may correspond only to the amount of the sublimation dye to move from the print medium M to the non-print medium L by utilizing the sublimation transfer property. This may lead to insufficiency of the absolute amount of the sublimation dye to move from the print medium M to the non-print medium L. Hence, it is difficult to obtain higher density of the image I formed on the non-print medium L.

3. MODIFICATION EXAMPLES

Matters including the configuration and the operation of the image forming apparatus described above may be modified where appropriate.

For example, in the case described with reference to FIGS. 2 to 4, both of the non-sublimation toner image TN and the sublimation toner image TD may be transferred onto the print medium M, and thereafter, the fixing process may be collectively performed on both of the non-sublimation toner image TN and the sublimation toner image TD, thereby forming the non-sublimation image GN and the sublimation image GD. The fixing process is performed once in this case.

In one modification example, the non-sublimation toner image TN may be transferred onto the print medium M and the fixing process may be performed on the transferred non-sublimation toner image TN to thereby form the non-sublimation image GN. Thereafter, the sublimation toner image TD may be transferred onto the non-sublimation image GN and the fixing process may be performed on the transferred sublimation toner image TD to thereby form the sublimation image GD. The fixing process is performed twice in this case.

The above-described modification example may also cause the non-sublimation image GN and the sublimation image GD to be stacked in this order on the print medium M upon the formation of the image G on the print medium M. Hence, it is possible to obtain an effect similar to that of the example embodiment described above.

The number of the fixing process to be performed is not particularly limited, and may be therefore any number. In one example embodiment, the fixing process may be performed once in order to efficiently perform the fixing process by reducing the number of the fixing process to be performed, as described above. In contrast, in another example embodiment, in a case where it is necessary to change the fixing condition on the basis of the type of the toners, the fixing process may be performed twice. The type of the toners may be, for example, the sublimation toner and the non-sublimation toner.

WORKING EXAMPLES

Working examples of one embodiment of the technology are described in detail below.

Experiment Examples 1 to 7

The image G was formed, by the following procedures, on the print medium M with the use of the image forming apparatus illustrated in FIG. 1. Thereafter, characteristics of the image G were evaluated.

[Preparation of Image Formation]

First, the image forming apparatus, the print medium M, and the toners were prepared. As the toners, four types of sublimation toners, i.e., the yellow sublimation toner, the magenta sublimation toner, the cyan sublimation toner, and the black sublimation toner, and one type of non-sublimation toner, i.e., the clear toner, were prepared.

[Image Forming Apparatus and Print Medium]

A color printer MICROLINE VINCI C941dn available from Oki Data Corporation located in Tokyo. Japan was used as the image forming apparatus. A printer paper of A4 size (Excellent white, size: 297 mm×210 mm) available from Oki Data Corporation located in Tokyo, Japan was used as the print medium M.

[Composition of Toners]

The yellow sublimation toner included 5 parts by mass of the yellow sublimation dye (C. L Reactive Yellow 2), 100 parts by mass of the binder resin (amorphous polyester), 1 part by mass of the electric charge control agent (BONTRON (registered trademark) P-51 available from Orient Chemical Industries Co., Ltd. located in Osaka, Japan), and 3 parts by mass of the external additive (hydrophobic silica fine powder R972 available from Nippon Aerosil Co., Ltd. located in Tokyo, Japan, and having an average particle size of 16 nm) relative to 100 parts by mass of the toner base particles.

The magenta sublimation toner had a composition similar to that of the yellow sublimation toner except that the magenta sublimation dye (C. L Reactive Red 3) was included in place of the yellow sublimation dye. The cyan sublimation toner had a composition similar to that of the yellow sublimation toner except that the cyan sublimation dye (C. L Disperse Blue 60) was included in place of the yellow sublimation dye. The black sublimation toner had a composition similar to that of the yellow sublimation toner except that the black sublimation dye (C. L Reactive Black 5) was included in place of the yellow sublimation dye.

The non-sublimation toner included 105 parts by mass of the binder resin (amorphous polyester and crystalline polyester), 4 parts by mass of the release agent (paraffin wax SP-0145 available from NIPPON SEIRO Co., Ltd. located in Tokyo, Japan, and having a melting point of 62° C.), 1 part by mass of the electric charge control agent (BONTRON (registered trademark) P-51 available from Orient Chemical Industries Co., Ltd. located in Osaka, Japan), and 4.5 parts by mass of the external additive (complex oxide particles, colloidal silica particles, and silica particles) relative to 100 parts by mass of the toner base particles. The binder resin included 100 parts by mass of the amorphous polyester and 5 parts by mass of the crystalline polyester. The external additive included 1 part by mass of composite oxide particles (STX801 available from Nippon Aerosil Co., Ltd. located in Tokyo, Japan. and having an average primary particle size of 18 nm) relative to 100 parts by mass of the toner base particles, 1 part by mass of colloidal silica particles (sol-gel silica X-24-9163A available from Shin-Etsu Chemical Co., Ltd. located in Tokyo, Japan, and having an average particle size of 100 nm) relative to 100 parts by mass of the toner base particles, 1 part by mass of silica particles (VPRY40S available from Nippon Aerosil Co., Ltd. located in Tokyo, Japan, and having an average particle size of 80 nm) relative to 100 parts by mass of the toner base particles, and 1.5 parts by mass of silica particles (RY50 available from Nippon Aerosil Co., Ltd. located in Tokyo, Japan, and having an average primary particle size of 40 nm) relative to 100 parts by mass of the toner base particles.

[Formation of Image]

Thereafter, the image G was formed on the print medium M with the use of the image forming apparatus mounted with the toners described above.

As environmental conditions, temperature was set to 25° C. and humidity was set to 55%. As conditions for forming the image G a speed of forming the image G, i.e., a linear speed of an outermost peripheral of the photosensitive drum, was set to 58.7 mm/sec, a traveling direction of the print medium M was set to a longitudinal direction of the print medium M, a voltage applied to the charging roller was set to +970 V, a voltage applied to the developing roller was set to −175 V, and a voltage applied to the feeding roller was set to −285 V.

In a case of forming the image G, the non-sublimation toner image TN and the sublimation toner image TD were stacked in this order on the print medium M. Thereafter, the fixing process was performed once. Thereby, the non-sublimation image GN and the sublimation image GD were stacked in this order on the print medium M.

In this case, the disposed amount (mg/cm$^2$) of the non-sublimation toner image TN was varied as described in Tables 1 to 4 by varying the voltage applied to the developing roller. The disposed amount of the non-sublimation toner image TN refers to the disposed amount of the non-sublimation toner image TN, i.e., the weight of the non-sublimation toner per unit area, on the print medium M, as described above.

Each of the four types of sublimation toners, i.e., the yellow sublimation toner, the magenta sublimation toner, the cyan sublimation toner, and the black sublimation toner, was used to form the sublimation image GD of the corresponding color having a solid image pattern and a printing rate of 100%. The non-sublimation toner was used to form the non-sublimation image GN having a solid image pattern and a printing rate of 100%.

In addition, the images G were formed on respective ten sheets of print media M with the use of the sublimation toner (the black sublimation toner) while increasing the printing rate by 10%. In other words, the images G having the respective printing rates of 10%, 20%, 30%, 40%, 50%, 60%, 70%, 80%, 90%, and 100% were formed on the respective ten sheets of print media M. The printing rate of 100% refers to a state where the image G having a solid image pattern is formed on the entire image formable region of the print medium M of the A4 size, by which a rate of an area occupied by the image G relative to an area of the image formable region is allowed to be 100%. The image formable region is the maximum range in which an image is formable.

In a case of forming the sublimation image GD of each color of yellow, magenta, cyan, and black with the use of the corresponding one of the yellow sublimation toner, the magenta sublimation toner, the cyan sublimation toner, and the black sublimation toner, the disposed amount of the sublimation image GD of the corresponding color was adjusted to a predetermined value. Specifically, in a case where the density of the image G of each color measured by a density measuring device on the print medium M was 1.50, the voltage applied to the developing roller was so adjusted that the disposed amount of the sublimation image GD formed with the use of the yellow sublimation toner was 0.50 mg/cm$^2$, the disposed amount of the sublimation image GD formed with the use of the magenta sublimation toner was 0.54 mg/cm$^2$, the disposed amount of the sublimation image GD formed with the use of the cyan sublimation toner was 0.59 mg/cm$^2$, and the disposed amount of the sublimation image GD formed with the use of the black sublimation toner was 0.64 mg/cm$^2$.

For comparison, the image G only including the sublimation image GD was formed on the print medium M by procedures similar to those described above except that the non-sublimation image GN was not formed and only the sublimation image GD was formed. In this case, the disposed amount of the non-sublimation toner image TN was 0 mg/cm$^2$.

[Evaluation of Characteristics of Image]

Next, so-called iron-on transfer was performed by the procedures described above, and the characteristics of the image G formed on the print medium M were evaluated. In this case, characteristics of the image I formed on the non-print medium L including a density characteristic and a gray-scale characteristic were examined as indices for evaluating the characteristic of the image G by the following procedures. The obtained results are described in Tables 1 to 4.

[Density Characteristic]

In a case of examining the density characteristic of the image I, the iron-on transfer on a T-shirt was performed with the use of the print medium M on which the images G of the respective colors having the printing rate of 100% were formed with the use of the respective sublimation toners, i.e., the yellow sublimation toner, the magenta sublimation toner, the cyan sublimation toner, and the black sublimation toner. In this case, the print medium M was closely attached to the non-print medium L, and thereafter, the heating source was pressed against the print medium M, as described with reference to FIG. 6.

As the non-print medium L, a fabric of polyester 100% was used. As the heating source, a heating press machine Model HTP234PS1 available from TheMagicTouch GmbH located in Dieburg, Germany was used. As the heating conditions, a temperature of the heating source was set to 200° C., and a time period during which the heating source was pressed on the non-print medium L was set to 120 seconds. Thereby, the image I corresponding to the image G was formed on the non-print medium L, as illustrated in FIG. 7.

After the print medium M was peeled off from the non-print medium L, the density of the image I of each color formed on the non-print medium L was measured by means of the density measuring device described above. Results described in Table 1 were obtained thereby. In this case, the number (a so-called n-number) of times of measuring the density was set to three (n=3). The value of the density was rounded to the nearest second decimal place. The densities described in Table 1 were measured on the non-print medium L (the fabric). In a case of performing the iron-on transfer, the sublimation toner moves to both of the print medium M and the non-print medium L. Therefore, in a case where adjustment is so performed that the density of the image G of each color measured on the print medium M is 1.50 as described above, the density of the image I of each color measured on the non-print medium L is lower than 1.50.

"Y, M, C, and K" in Table 1 describes the type, i.e., the color, of the sublimation toner. "Y" indicates yellow, "M" indicates magenta, "C" indicates cyan, and "K" indicates black.

TABLE 1

| Printing rate = 100% | | | | | |
|---|---|---|---|---|---|
| Experiment | Disposed amount | Density | | | |
| example | (mg/cm$^2$) | Y | M | C | K |
| 1 | 0 | 1.31 | 1.34 | 1.22 | 1.23 |
| 2 | 0.10 | 1.31 | 1.33 | 1.25 | 1.26 |
| 3 | 0.20 | 1.33 | 1.32 | 1.38 | 1.28 |
| 4 | 0.29 | 1.33 | 1.32 | 1.39 | 1.29 |
| 5 | 0.38 | 1.39 | 1.39 | 1.46 | 1.43 |
| 6 | 0.49 | 1.37 | 1.37 | 1.48 | 1.41 |
| 7 | 0.65 | 1.36 | 1.39 | 1.47 | 1.38 |

[Gray-Scale Characteristic]

In a case of examining the gray-scale characteristic of the image I, first, the iron-on transfer described above was performed with the use of the print medium M on which the image G having the printing rate of corresponding one of 10% to 100% was formed. The images G on the respective print media M were formed with the use of the black sublimation toner while the printing rate was increased by 10%. The images I corresponding to the respective images G were thereby formed on the respective non-print media L.

Thereafter, the densities of two types of images I, i.e., the image I having the printing rate of 10% and the image I having the printing rate of 100%, were measured by means of the density measuring device. Thereafter, a difference in density between the two types of the images I was calculated. Thereby, results described in Table 2 were obtained. In this case, the number of times of measuring the density was set to three (n=3). The value of the density was rounded to the nearest second decimal place. The difference in density represents a color-reproducible range of density, i.e., a difference between a density of a higher-density image and a density of a lower-density image. The difference in density was calculated by the expression: (difference in density)=(the density of the image I having the printing rate of 100%−the density of the image I having the printing rate of 10%).

TABLE 2

| Sublimation toner: Black sublimation toner, Non-sublimation toner: Clear toner | | | | | |
|---|---|---|---|---|---|
| Experiment example | Disposed amount (mg/cm$^2$) | Density (Printing rate = 100%) | Density (Printing rate = 10%) | Difference in density | Color reproducibility level |
| 1 | 0 | 1.26 | 0.33 | 0.93 | 4 |
| 2 | 0.10 | 1.30 | 0.29 | 1.01 | 5 |
| 3 | 0.20 | 1.30 | 0.29 | 1.01 | 5 |
| 4 | 0.29 | 1.30 | 0.29 | 1.01 | 5 |
| 5 | 0.38 | 1.33 | 0.31 | 1.02 | 5 |
| 6 | 0.49 | 1.31 | 0.28 | 1.03 | 5 |
| 7 | 0.65 | 1.32 | 0.29 | 1.03 | 5 |

Thereafter, a color reproducibility level of the image I was determined on the basis of the difference in density described above. The color reproducibility level was determined as "5" in a case where the difference in density was greater than 1.0. The color reproducibility level was determined as "4" in a case where the difference in density was greater than 0.9 and equal to or smaller than 1.0. The color reproducibility level was determined as "3" in a case where the difference in density was greater than 0.8 and equal to or smaller than 0.9. The color reproducibility level was determined as "2" in a case where the difference in density was greater than 0.7 and equal to or smaller than 0.8. The color reproducibility level was determined as "1" in a case where the difference in density was equal to or smaller than 0.7. The highest color reproducibility level is "5" and the lowest color reproducibility level is "1". Accordingly, the color reproducibility level of "5" is more favorable than the color reproducibility level of "1".

Thereafter, the density of each of the ten types of images I was measured by means of the density measuring device, by which ten density values were obtained. Each of the ten types of images I had the corresponding printing rate in a range from 10% to 100%. Upon the measurement, the number (the n-number) of times of measuring the density was set to three (n=3), and the value of the density was rounded to the nearest second decimal place. Thereafter, linear approximation of the ten values of density was obtained by means of a least squares method to calculate correlation coefficients related to the linear approximation, by which results described in Table 3 were obtained. Values of the correlation coefficients were rounded to the nearest third decimal place. The value of the correlation coefficient closer to "1" indicates that a relationship between the printing rate and the density is closer to a proportional relationship. In other words, the value of the correlation coefficient closer to "1" indicates that a variation amount of the density relative to a variation amount of the printing rate is closer to a constant amount.

Thereafter, density gradient levels of the respective images I were determined on the basis of the correlation coefficients described above. The density gradient level was determined as "5" in a case where the correlation coefficient was greater than 0.980. The density gradient level was determined as "4" in a case where the correlation coefficient was greater than 0.970 and equal to or smaller than 0.980. The density gradient level was determined as "3" in a case where the correlation coefficient was greater than 0.960 and equal to or smaller than 0.970. The density gradient level was determined as "2" in a case where the correlation coefficient was greater than 0.950 and equal to or smaller than 0.960. The density gradient level was determined as "1" in a case where the correlation coefficient was equal to or smaller than 0.950. The highest density gradient level is "5" and the lowest density gradient level is "1". Accordingly, the density gradient level of "5" is more favorable than the density gradient level of "1".

TABLE 3

| Sublimation toner: Black sublimation toner, Non-sublimation toner: Clear toner | | | |
|---|---|---|---|
| Experiment example | Disposed amount (mg/cm$^2$) | Correlation coefficient | Density gradient level |
| 1 | 0 | 0.949 | 2 |
| 2 | 0.10 | 0.961 | 3 |
| 3 | 0.20 | 0.966 | 3 |
| 4 | 0.29 | 0.968 | 3 |
| 5 | 0.38 | 0.977 | 4 |
| 6 | 0.49 | 0.976 | 4 |
| 7 | 0.65 | 0.977 | 4 |

Lastly, the results of the determination of the color reproducibility level described in Table 2 and the results of the determination of the density gradient level described in Table 3 were put together to obtain results described in Table 4. In this case, the sum of the value of the color reproducibility level and the value of the density gradient level was set as a gray-scale reproducibility level. The gray-scale reproducibility level is an index indicating so-called seamlessness of the gray-scale (gradation). It is to be noted that a greater value of the gray-scale reproducibility level is more favorable.

TABLE 4

| Sublimation toner: Black sublimation toner, Non-sublimation toner: Clear toner | | | |
|---|---|---|---|
| Experiment example | Color reproducibility level | Density gradient level | Gray-scale reproducibility level |
| 1 | 4 | 2 | 6 |
| 2 | 5 | 3 | 8 |
| 3 | 5 | 3 | 8 |
| 4 | 5 | 3 | 8 |
| 5 | 5 | 4 | 9 |
| 6 | 5 | 4 | 9 |
| 7 | 5 | 4 | 9 |

[Discussion]

As described in Table 1, the density obtained in a case where the non-sublimation toner image TN was formed (Experiment examples 2 to 7) was almost equivalent or higher than that obtained in a case where the non-sublimation toner image TN was not formed (Experiment example 1).

In particular, in a case where the non-sublimation toner image TN was formed, on a condition that the disposed amount of the non-sublimation toner image TN was equal to or greater than 0.10 mg/cm$^2$, a high density of 1.25 or higher was obtained. In the above-described case, on a condition that the disposed amount of the non-sublimation toner image TN was equal to or greater than 0.20 mg/cm$^2$, a higher density that reached about 1.30 was obtained. In the above-described case, on a condition that the disposed amount of the non-sublimation toner image TN was equal to or greater than 0.38 mg/cm$^2$, a further higher density that reached about 1.40 was obtained. It is to be noted that, on a condition that the disposed amount of the non-sublimation toner image TN was equal to or smaller than 0.65 mg/cm$^2$, a high density of 1.25 or higher was obtained stably.

As described in Tables 2 to 4, in the case where the non-sublimation toner image TN was formed (Experiment examples 2 to 7), on the condition that the disposed amount of the non-sublimation toner image TN was equal to or greater than 0.10 mg/cm$^2$, both the color reproducibility level and the density gradient level were improved, and therefore the gray-scale reproducibility level was also improved, compared with the case where the non-sublimation toner image TN was not formed (Experiment example 1).

In particular, in the case where the non-sublimation toner image TN was formed, on the condition where the disposed amount of the non-sublimation toner image TN was equal to or greater than 0.38 mg/cm$^2$, the density gradient level was further improved, and therefore, the gray-scale reproducibility level was also further improved.

CONCLUSION

According to the results described in Tables 1 to 4, so transferring the non-sublimation toner image TN and the sublimation toner image TD in this order onto the print medium M that the transfer region of the non-sublimation toner image TN and the transfer region of the sublimation toner image TD were overlapped with each other improved the density characteristic and the gray-scale characteristic of the image I in a case where the image G formed on the print medium M was transferred onto the non-print medium L such as a fabric. Accordingly, the image I with higher quality was formed on the non-print medium L. Further, the image G that allowed for formation of the image I with higher quality was obtained.

The technology has been described above referring to some example embodiments and the modification examples thereof; however, the technology is not limited to the example embodiments and the modification examples described above, and is modifiable in various ways. For example, the image forming apparatus according to one example embodiment of the technology is not limited to a printer, and may be a copying machine, a facsimile, a multi-functional apparatus, or any other suitable apparatus that forms an image. For example, the image forming apparatus according to one example embodiment of the technology is not limited to a case adopting an intermediate transfer method using an intermediate transfer medium, and may be applied to a case adopting a direct transfer method without using the intermediate transfer medium.

Furthermore, the technology encompasses any possible combination of some or all of the various embodiments and the modifications described herein and incorporated herein. It is possible to achieve at least the following configurations from the above-described example embodiments of the technology.

(1)

An image forming apparatus including an image forming section including a first toner image forming unit forming a sublimation toner image with use of a sublimation toner, the sublimation toner including a sublimation dye, and a second toner image forming unit forming a non-sublimation toner image with use of a non-sublimation toner, the non-sublimation toner not including the sublimation dye, the image forming section transferring the non-sublimation toner image and the sublimation toner image in this order on a print medium and thereby causing a transfer region of the non-sublimation toner image and a transfer region of the sublimation toner image to be overlapped with each other.

(2)

The image forming apparatus according to (1), in which a disposed amount of the formed non-sublimation toner image is equal to or greater than 0.10 milligrams per square centimeter.

(3)

The image forming apparatus according to (2), in which the disposed amount of the formed non-sublimation toner image is equal to or greater than 0.20 milligrams per square centimeter.

(4)

The image forming apparatus according to (3), in which the disposed amount of the formed non-sublimation toner image is equal to or greater than 0.38 milligrams per square centimeter.

(5)

The image forming apparatus according to any one of (2) to (4), in which the disposed amount of the formed non-sublimation toner image is equal to or smaller than 0.65 milligrams per square centimeter.

(6)

The image forming apparatus according to any one of (1) to (5), in which the non-sublimation toner includes no colorant and includes polyester-based resin.

(7)

The image forming apparatus according to (6), in which the non-sublimation toner includes a clear toner.

(8)

The image forming apparatus according to any one of (1) to (7), in which the image forming section further includes an intermediate transfer medium, and the image forming section transfers the sublimation toner image and the non-sublimation toner image in this order onto the intermediate transfer medium, and thereafter transfers the non-sublimation toner image and the sublimation toner image in this order from the intermediate transfer medium onto the print medium.

(9)

The image forming apparatus according to any one of (1) to (8), further including a fixing section that fixes, to the print medium, the non-sublimation toner image and the sublimation toner image both transferred onto the print medium by the image forming section.

(10)

The image forming apparatus according to (9), in which the image forming section stacks the non-sublimation toner image and the sublimation toner image in this order on the print medium, and the fixing section collectively fixes, to the print medium, the non-sublimation toner image and the sublimation toner image both stacked on the print medium by the image forming section.

(11)

The image forming apparatus according to any one of (1) to (10), in which the sublimation dye has a sublimation transfer property that causes the sublimation dye to move from the print medium to a non-print medium with use of thermal energy.

According to the image forming apparatus of one embodiment of the technology, the non-sublimation toner image and the sublimation toner image are so transferred in this order onto the print medium that the transfer region of the non-sublimation toner image and the transfer region of the sublimation toner image are overlapped with each other. This makes it possible to form a high-quality image on a non-print medium such as a fabric when the images formed on the print medium are transferred onto the non-print medium.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising an image forming section including a first toner image forming unit forming a sublimation toner image with use of a sublimation toner, the sublimation toner including a sublimation dye, and a second toner image forming unit forming a non-sublimation toner image with use of a non-sublimation toner, the non-sublimation toner not including the sublimation dye, the image forming section transferring, on a print medium, the sublimation toner image formed by the first toner image forming unit, and transferring, on the print medium, the non-sublimation toner image formed by the second toner image forming unit, and the image forming section transferring the non-sublimation toner image and the sublimation toner image in this order on the print medium and thereby causing a transfer region of the non-sublimation toner image and a transfer region of the sublimation toner image to be overlapped with each other.

2. The image forming apparatus according to claim 1, wherein a disposed amount of the formed non-sublimation toner image is equal to or greater than 0.10 milligrams per square centimeter.

3. The image forming apparatus according to claim 2, wherein the disposed amount of the formed non-sublimation toner image is equal to or greater than 0.20 milligrams per square centimeter.

4. The image forming apparatus according to claim 3, wherein the disposed amount of the formed non-sublimation toner image is equal to or greater than 0.38 milligrams per square centimeter.

5. The image forming apparatus according to claim 2, wherein the disposed amount of the formed non-sublimation toner image is equal to or smaller than 0.65 milligrams per square centimeter.

6. The image forming apparatus according to claim 1, wherein the non-sublimation toner includes no colorant and includes polyester-based resin.

7. The image forming apparatus according to claim 6, wherein the non-sublimation toner comprises a clear toner.

8. The image forming apparatus according to claim 1, wherein the image forming section further includes an intermediate transfer medium, and the image forming section transfers the sublimation toner image and the non-sublimation toner image in this order onto the intermediate transfer medium, and thereafter transfers the non-sublimation toner image and the sublimation toner image in this order from the intermediate transfer medium onto the print medium.

9. The image forming apparatus according to claim 1, further comprising a fixing section that fixes, to the print medium, the non-sublimation toner image and the sublimation toner image both transferred onto the print medium by the image forming section.

10. The image forming apparatus according to claim 9, wherein the image forming section stacks the non-sublimation toner image and the sublimation toner image in this order on the print medium, and the fixing section collectively fixes, to the print medium, the non-sublimation toner image and the sublimation toner image both stacked on the print medium by the image forming section.

11. The image forming apparatus according to claim 1, wherein the sublimation dye has a sublimation transfer property that causes the sublimation dye to move from the print medium to a non-print medium with use of thermal energy.

* * * * *